US009003641B2

(12) United States Patent
Stuth

(10) Patent No.: US 9,003,641 B2
(45) Date of Patent: Apr. 14, 2015

(54) METHOD FOR PRODUCING A NICKEL STRIP

(76) Inventor: Theodor Stuth, Neuss (DE)

( * ) Notice: Subject to any disclaimer, the term of this patent is extended or adjusted under 35 U.S.C. 154(b) by 142 days.

(21) Appl. No.: 13/521,296

(22) PCT Filed: Feb. 4, 2011

(86) PCT No.: PCT/EP2011/000509

§ 371 (c)(1),
(2), (4) Date: Aug. 29, 2012

(87) PCT Pub. No.: WO2011/107199

PCT Pub. Date: Sep. 9, 2011

(65) Prior Publication Data

US 2012/0311859 A1 Dec. 13, 2012

(30) Foreign Application Priority Data

Mar. 5, 2010 (DE) ..... 10 2010 010 536

(51) Int. Cl.
*H01F 7/06* (2006.01)
*C22C 1/02* (2006.01)

(52) U.S. Cl.
CPC ..... *C22C 1/02* (2013.01)

(58) Field of Classification Search
USPC ..... 29/605, 606, 835, 854, 874, 878; 72/41, 72/203, 229; 164/462, 463, 476; 420/63, 420/72
See application file for complete search history.

(56) References Cited

U.S. PATENT DOCUMENTS

| | | | | |
|---|---|---|---|---|
| 1,131,037 | A | 3/1915 | Cary | |
| 3,722,073 | A | 3/1973 | Larson | |
| 5,675,209 | A * | 10/1997 | Hall et al. | 313/141 |
| 7,950,124 | B2 | 5/2011 | Stuth | |
| 2010/0215981 | A1 * | 8/2010 | Edelman et al. | 428/659 |

FOREIGN PATENT DOCUMENTS

| | | | |
|---|---|---|---|
| GB | 2042379 | A | 9/1980 |

* cited by examiner

*Primary Examiner* — Paul D Kim
(74) *Attorney, Agent, or Firm* — Andrew Wilford

(57) ABSTRACT

A nickel strip is made from a starting material of solid cathode sheets having a minimum nickel content of 99.94% by weight and a maximum trace element content, in ppm by weight, of <35 carbon, <5 sulphur, <14 manganese, <11 magnesium, <11 aluminum, <25 titanium, and <15 silicon. The sheets are hot-rolled individually in a single layer/ply. The sheets are then joined to form the strip.

14 Claims, 6 Drawing Sheets

| | |
|---|---|
| ASTM particle size | 5.4 |
| Average chord length | 50µm |
| Average particle area | 3660 µm |
| Average particle diameter | 60µm |
| Particles/area | 273/µm |
| Specific particle limit surface | 0/µm |

METHOD FOR PRODUCING A NICKEL STRIP

CROSS REFERENCE TO RELATED APPLICATIONS

This application is the US-national stage of PCT application PCT/EP2011/000509 filed 4 Feb. 2011, published 9 Sep. 2011 as WO2011/107199, and claiming the priority of German patent application 102010010536.8 itself filed 5 Mar. 2010.

FIELD OF THE INVENTION

The invention relates to the manufacture of strips composed of nickel cathode sheets, in particular composed of a plurality of at least substantially solid cathode sheets, the differences in thickness within sheets and between various sheets preferably being balanced by hot rolling without heating prior to the hot rolling and the hot rolling itself resulting in an oxide layer that is no longer reducible to nickel, or resulting in irreversible intergranular corrosion and internal corrosion. Whenever nickel is mentioned in the general portion of this description or in the description of specific embodiments, one skilled in the art similarly also considers cobalt to be disclosed as an alternative metal. All aspects described herein that are essential to the invention likewise apply to cobalt.

PRIOR ART

Strips made of nickel are produced primarily by reduction smelting. To limit nonmetallic oxidic impurities, melting and pouring are performed in the VIM process, and to eliminate porosity, remelting in the ESR or VAR process is performed. Surface cracks, which result due to the high shrinkage rate of nickel, must be removed by grinding; the amount removed is approximately 6 to 9 mm. Hot rolling usually begins at temperatures of approximately 1150° C. to 1250° C. Not only a surface oxide layer, but also intergranular corrosion results from hot rolling. The thickness of the oxide layer and of the near-surface layer affected by intergranular corrosion depend on the purity level of the material, the exposure time, and the processing temperature. These layers (on both sides of the strip) have a total layer thickness of approximately 50 μm. Oxides have only slight deformation capability. If the layers affected by oxidation were not completely removed, during the subsequent cold rolling into foils, rolled-in oxides would result in holes in the strip and strip breakage. Rolled-in oxides result in surface defects. Structural damage caused by intergranular corrosion results in irreparable loss of strength.

During melting in arc furnaces and induction furnaces, deoxidation is carried out using silicon or aluminum, titanium (approximately 0.03%) is added to bind nitrogen, and sulfur is bound to manganese (approximately 0.3%) or magnesium (approximately 0.05%). Magnesium, silicon, aluminum, and titanium are also used for deoxidation during tapping. Although these elements sometimes become slagged, a considerable portion also remains in the melt. Nickel melted in this way therefore contains impurities of the mentioned elements in levels of >100 ppm to several thousand ppm for each of the elements used.

Thus, the manufacture of strip by hot rolling of material produced by reduction smelting is associated with the following disadvantages:

- Oxidation not only of the surface, but also of the near-surface grain boundaries, and internal corrosion
- Oxide layer that is loose, not firmly adherent
- Two-layer structure of the oxide layer, where primarily the top oxide layer chips off under alternating thermal load due to the different coefficients of expansion of the two layers
- Formation of pores at the boundary between the metal and the oxide layer.

As a result, blocks and strips that are produced by reduction smelting must be pickled and/or ground, whereby not only the surface oxides, but also the near-surface areas affected by intergranular corrosion and internal corrosion are removed. The facilities required for the material removal entail high capital and operating costs. Waste is generated for an expensive material, and at a relatively high level of refinement.

The use of electrolytically obtained starting material has previously been proposed to avoid the disadvantages of using reduction smelting.

According to DE 2905508 (Hurdelbrink) [GB 2,042,379], cathode sheets are initially cut into strips "in a cold process" (column 2, line 44), the strips are optionally joined at the edges, and the strip produced in this manner is further processed. (Joining at the end would only restore the original dimensions.) The patent does not claim a method of producing a metal strip composed of welded-together cathode sheets that are substantially solid, but, rather, claims a method of making a metal strip that has been formed from strips that represent cut-up cathode sheets. The strip-shaped cutting of solid cathode sheets is a feature characteristic of claim 1 of the cited patent. The advantage of the method is that, for the starting material used, deviations in thickness occur only to the extent to which these exist in a plate, not between various plates.

Solid cathode sheets are explicitly described as being unsuitable for direct conversion into elongated shapes by rolling (column 1, line 57ff.). Since in contrast to hot rolling, in cold rolling only a slight degree of mass balancing takes place over the width, the method described in DE 2905508—unlike the method described in WO 2006024526 [U.S. Pat. No. 7,950,124]—also cannot be used on solid cathode sheets.

In claim 6 and illustrated embodiment III, it is provided that before being split, the cathode plates as a whole may be reduced in thickness by rolling "in order to create a certain thickness." In this regard, the description (column 3, line 35ff.) states that reducing the plate thickness simplifies the splitting into strips. It is known that solid cathode plates, in their thickness as produced, are difficult to cut due to their columnar structure. Cathode shears that are able to cut through the entire thickness of the sheets therefore represent expensive customized approaches. In any event, the roll gap facilities mentioned in DE 2905508 (column 3, line 31ff.) are not suitable for cutting solid plates, but, rather, for cutting sheets that have been reduced in thickness by rolling. Therefore, the method is used for "simplifying the splitting into strips," not for balancing the thickness of various sheets.

Incidentally, deviations in thickness within cathode sheets and between various sheets are not mentioned at all in DE 2905508; thus, the process description is also not explicitly directed to the problems of manufacturing a strip of constant thickness. This is also not necessary when elongated anode plates, for example, are to be manufactured, since dimensional accuracy is not relevant in this case.

DE 2905508 also does not mention cold rolling using back tension applied by reels. Rather, even after the joining of sheets that are reduced by rolling and then split and joined on the end-face side, these are still referred to as "rods," and coiling is described as a separate step after the rolling ("then," column 4, line 7). DE 2905508 therefore discloses a sheet process, not a strip rolling process in which the rolling using reel tension is an integral component. The reason for dispensing with reel tension during rolling is that in DE 2905508 no method is stated for producing a pore-free weld seam; however, pores reduce the effective cross section and result in tearing of the strip under reel tension. Thus, the weight of the producible units is limited by the length of the roller tables before and after the roll stand ("up to 2 t weight," column 4, line 8).

In U.S. Pat. No. 3,722,073 (Larson) it is proposed to arrange solid cathode sheets one behind the other and on top of one another, and to stabilize the resulting pack by tack welding, followed by hot rolling. The hot rolling of individual sheets is explicitly ruled out due to the complexity and expense of handling (column 1, line 62ff.).

The stated process specifications (for example, reduction rate ≥75%, preferably ≥96%) are used to avoid bubble formation (blistering) that occurs during annealing after cold rolling. Separation of the sheets during cold rolling is also avoided. A particular stated advantage is that large numbers of production units are achievable by stacking the sheets. In contrast to rolling individual sheets, the rolling of hot strip from blocks is a very productive process.

However, after the hot rolling, up to 5% of the surface area of each of the mutually facing sheets is not bonded. The unbonded areas therefore increase linearly with the number of stacked sheets. Sheets having unbonded areas are not marketable. As a result of the hot rolling step, the entire strip is scaled with a porous oxide layer, and deep intergranular corrosion occurs. On the other hand, it is possible to avoid surface corrosion of the individual sheets in the stack. Blasting, grinding, or pickling of the surface is necessary in order to remove the resulting oxide layer.

The design of the method results in a dilemma: the thinnest possible strips must be produced in order to make use of the productivity of the hot rolling. The typical starting material for the cold rolling is relatively thin strips of 2.5 to 2.0 mm thickness, since nickel is tough and difficult to deform by cold rolling. However, the thinner the strip that results from the hot rolling process, the higher the scrap rate due to scaling. In the example provided by the applicant (Example II), the percentage of scrap is approximately 12.6%, assuming that for a total strip thickness of 3.175 mm, 0.20 mm per side is removed by pickling. Pickling residues or grinding residues are not marketable as pure metal.

WO 2006024526 (EP 1784273[U.S. Pat. No. 7,950,124], DE 102004042481; Stuth) describes a method of arranging and joining cathode sheets prior to hot rolling or cold rolling. Heat deformation is to be avoided since the material oxidizes and the oxide layers are difficult to remove. The harmfulness of H and S is described; limitations regarding the analysis of the starting material are not quantified.

The described sorting processes are unnecessary for the method described here, at least when sheets are hot-rolled. It is also not necessary to adapt the control of facilities; instead, existing industrial facilities may be easily used.

For the manufacture of packaging strip made of steel, it is known in the prior art to join dimensionally accurate sheets of equal thickness by welding to form a strip (U.S. Pat. No. 1,131,037; Cary).

In the prior art it has not been necessary to consider strip made of a starting material of different thicknesses, since in the production by reduction smelting and subsequent hot rolling, the starting material for the sheets to be joined always has the same thickness, regardless of whether this starting material was obtained using ingot casting or continuous casting. The thickness of the sheets that are to be subsequently joined is set in a targeted manner.

The targeted balancing of the thickness by hot rolling is a technique that solves a problem that arises only with cathode sheets. However, in contrast to production of slabs by reduction smelting, the thickness of the cathode sheets cannot be influenced. The thickness of the cathode sheets depends on their position in the tank house, the flow at this position, and the proximity to the inflow of the electrolyte that is rich in metal ions.

OBJECT OF THE INVENTION

Based on the production process, nickel cathode sheets have the following characteristics:

- Three-layer structure with different hardnesses of the inner sheet and outer sheets
- Handles whose ends are welded to the starter sheet, resulting in a double material thickness at these locations
- Sheets are not planar
- Different thicknesses within a plate: generally a convex cross section, but significant deviations in thickness and sloping edges
- Different average thicknesses of various plates
- Columnar structure
- Hydrogen charging.

In order to manufacture strip from sheets, the sheets must be joined at one edge. In particular when the joining point is to be rolled, the abutting edges must have no projections, sunken areas, or gaps.

The welding of sheets to form a strip is simplified if the sheets to be joined have a uniform thickness, i.e. there are no differences in thickness either between various sheets or within a sheet, and the sheets are planar. For cathode sheets as starting material, none of these requirements are present; however, they may all be met by hot rolling. However, embrittlement, surface oxidation, deep intergranular corrosion, and internal corrosion are associated with the hot rolling of nickel. According to the prior art, hot-rolled strip must therefore be pickled or ground.

The object of the proposed method is to use hot rolling for balancing the thicknesses within and between various nickel cathode sheets; it should not be possible for embrittlement, internal oxidation, or intergranular corrosion to occur in the strip due to heating and hot rolling, and at most, a thin, tight oxide layer essentially one layer thick results on the strip, which may be converted by reduction annealing to pure nickel that firmly adheres to the base body. The object is to avoid having to encapsulate the hot rolling stand to prevent entry of air. In addition, the sheets must be weldable before they are joined, regardless of whether this occurs before or after the hot rolling.

The object is to avoid bubble formation in the metal during annealing, and separation at the starter sheet during cold rolling.

The oxide layer that results during heating and hot rolling should still be plastically deformable in such a way that the sheets after hot rolling and joining or the strip produced from the sheets after the hot rolling, may be coiled up without the oxide layer chipping off.

The object is to reduce the percentage of scrap by finding a use for the edge sections to be separated.

SUMMARY OF THE INVENTION

These objects are achieved by a method according to the invention where the sheets are hot-rolled individually in a single layer/single ply before or after being joined to form the strip, and prior to the hot rolling, a starting material of the sheets has, as determinable in particular by optical emission spectral analysis, a minimum nickel content of 99.94% by weight and a maximum trace element content, in ppm by weight, of <35 carbon, <5 sulphur, <14 manganese, <11 magnesium, <11 aluminum, <25 titanium, and <15 silicon. More particularly the minimum nickel content is, in % by weight, ≥99.98 and the maximum trace-element content is, in ppm by weight, ≥20 carbon, ≥2 sulphur, ≥5 manganese, <5 magnesium, ≥5 aluminum, <105 titanium, and ≥10 silicon.

DEFINITIONS

The terms listed below are defined as follows:

"solid cathode sheets" are understood to mean sheets that result during electrolysis, whereby the hangers (loops) may already be separated.

"Essentially solid cathode sheets" are understood to mean sheets that are solid cathode sheets up to the edge regions. The edge regions are characterized in that their surface thickness decreases or on the other hand greatly increases (namely, where hangers were welded to the sheet, and where their residues remain on the sheet after the projecting parts are cut off). These edge regions are separated after the hot rolling. Sheets divided into strips do not fall under the term "essentially solid cathode sheets."

"Strip" is understood to mean a flat body that results from the at least essentially solid cathode sheets being welded to one another at the edges. The term "strip" is used in the metal industry in various combinations (strip rolling mill, strip steel). Because cathode sheet manufacturers supply sheets having very different dimensions for which there are no fixed longitudinal and transverse sides at the outset, the strips manufactured from sheets may have a width between approximately 500 mm and several meters, the latter occurring in particular when the sheets are joined at their long sides only after the hot rolling. The stated dimensions are for illustrative purposes only, and do not definitively specify the strip widths that are achievable by the method.

The term "one layer/one-ply" hot rolling clarifies that the method does not relate to hot-rolled sheets that are coated and thus fixed.

Nickel oxide layers composed of two layers have a ratio of approximately 50:50. An "essentially one-layer oxide layer" is intended to also include a two-layer oxide layer when the two layers have a ratio of ≤10:≥90.

A thin oxide layer is understood to mean a layer that does not exceed a thickness of approximately 10 μm upon heating to 1100° C. with a holding period of 800 seconds. In the described application example, the thickness of the oxide layer after the hot rolling was 2 μm.

In the determination of the minimum reduction rate, the sheet thickness is considered to be the thickest location on the sheet, with buttons being disregarded.

"Technical zero gap" is understood to mean that for sheets placed together at their edges, at no location is there a gap >2 mm, preferably a gap >1 mm. The edges of the sheets may be chamfered.

Welding gases are considered to be "free of" other quantities of gas when they contain minor constituents such as those present in standard mixtures that are commercially produced and offered as cylinder gas. The same applies for a pure gas that is intended to contain 100% of an element; for example, 100% argon contains the following nonharmful minor constituents:

Minor constituents of argon

| Gas | ppm |
|---|---|
| $CO_2$ | ≤1 |
| $N_2$ | ≤10 |
| $O_2$ | ≤4 |
| $H_2O$ | ≤5 |

"Pure nickel" and "ultrapure nickel" are understood to mean nickel having a purity level of ≥99.94% by weight. The approach according to the invention for achieving the object lies in limiting or reducing in a targeted manner the allowable trace elements in the cathode sheets, which are already pure per se, in such a way that during heating prior to the hot rolling and during the hot rolling itself, no intergranular corrosion or internal corrosion occurs, or, if it occurs, it may be removed, together with the resulting oxide layer, by reducing annealing the morphology of the oxide layer is developed in such a way that it is flexible enough that strip manufactured from the sheets may be coiled up, and a resulting oxide layer may be converted into pure nickel by reducing annealing.

Thus, the adhesion of the oxide layer to the base material, and if applicable, the adhesion between various oxide layers, is also important. The layers must not chip off during heating and cooling.

Depending on the purity level in general and the concentration of trace elements in particular, nickel may form a one-layer or a two-layer oxide layer. With regard to the aim of removing the resulting oxide layer by reducing annealing, a two-layer oxide layer is undesirable. When nickel of various qualities oxidizes, the extent of internal corrosion and intergranular corrosion may vary greatly. There is a clear correlation between the number of oxide layers on the one hand and the occurrence of intergranular corrosion and internal corrosion on the other hand: there are compositions that upon oxidation develop an oxide composed of two layers, but that have no intergranular corrosion. However, very pure nickel produced in the laboratory, having a purity level of ≥99.997%, develops only a one-layer oxide layer upon heating, with no intergranular corrosion or internal corrosion.

Nickel produced by reduction smelting having quality grades of Ni 200 develops a two-layer oxide layer and deep intergranular corrosion and internal oxidation under fairly long high-temperature oxidation. The same applies for Ni 270 produced by powder metallurgy, although it has the same high purity level as the best material obtained electrolytically (99.98%). Thus, the manufacturing process and the trace elements typically associated with it are also important.

Despite their much higher purity level compared to material produced by reduction smelting, electrolytically produced cathode sheets, which achieve only the analytical values of ASTM B 39-79 (reapproved 2004), have a two-layer oxide layer and exhibit intergranular corrosion as well as internal corrosion. According to the prior art, sandblasting, pickling, or grinding are necessary after the hot rolling of cathode nickel, in particular pure nickel (U.S. Pat. No. 3,722,073, for example in column 7, lines 35 and 62).

On the other hand, it is known that for nickel produced in the laboratory having a purity level of ≥99.997%, a tight one-layer oxide layer forms that prevents internal corrosion and intergranular corrosion. However, these types of pure cathode sheets are not produced on the commercial scale using hydrometallurgical processes.

The starting point for the considerations was that for manufacturing on the commercial scale it is not practicable to increase the purity level of cathode sheets to ≥99.997%, and that this might not even be necessary if the important issue is not the absolute purity level, but, rather, the limitation of certain trace elements identified as critical. This may be achieved using suitable measures such as heat treatment, and making a selection after chemical analysis of the trace elements in various cathode qualities available on the market, whose content of trace elements differs significantly even if the requirements of ASTM B 39-79 (reapproved 2004) are met.

The following elements have been identified as critical:

Gases and gas-forming elements

Elements that form gases upon heating, possibly only due to a chemical reaction, expand, resulting in either formation of bubbles in the material or loosening of the grain structure due to the gas pressure, or creation of voids, in particular at the grain boundaries. This applies for C.

Gases that result in increased porosity of the melt or bath spattering during fusion welding are also critical. This applies for H and N. H in particular results in microporosity during cooling of the melt after welding.

Segregating elements. Such elements are elements for which heat treatment does not result in concentration balancing due to diffusion, and that instead concentrate at grain boundaries, and that from there reach the material surface, thus infiltrating and detaching oxide layers, and at that location form compounds that melt at low temperature and thus impair the material cohesion (decohesion), in particular during hot working.

Such elements are the following:

Metals: Bi, Pb, Mn, Al

Metalloids: Te, Se, Si

Nonmetals: S, P

Si may form a surface film on nickel, and with other elements that readily segregate, namely, Mn and Al, may form a glass-like film composed of manganese silicate ($Mn_3Si_8Al_3$) on the metal. This occurs when heating is carried out in a moist atmosphere.

Elements that oxidize before nickel, form stable oxides, and therefore enrich in the oxide layer and form layers An indication for identifying such elements is that on the electronegativity scale, They have lower values than nickel (Mg, Mn, Ti, Al, Cr, Zn, Fe, Si, and Sn)

They have values practically equal to that of nickel (Co, Cu, Pb, Ag, Bi, As).

The oxidation of Mn, Si, Ti, Al, Mg cannot be prevented during heating and hot rolling. These oxides can hardly be removed using heat-treatment processes. The near-surface oxidation of these elements and their oxidation at grain boundaries displace nickel, provided that the oxidation is associated with a volume increase. The resulting surface structure promotes the formation of a two-layer oxide layer. The content of these elements in the nickel must therefore be limited to the greatest extent possible.

To achieve the stated object of the invention, it is not sufficient to identify the critical elements; they must also be quantified. However, due to the interactions between the trace elements, determining the allowable contents of these elements is not a trivial matter. Thus, for example, for nickel qualities produced by reduction smelting, even for C contents of 250 ppm, only limited loosening of the grain boundaries occurs; however, such loosening occurs in electrolytically produced nickel having a much lower C content. The same applies for sulfur: 50 ppm sulfur in material produced by reduction smelting is much less harmful than 10 ppm in electrolytically produced material. The isolated reduction of one trace element may increase the detrimental effects of another trace element, whose content must then likewise be limited.

Limited Trace Elements

It is known that trace elements such as H, C, N, and S may be removed by heat-treatment processes. Claim 1 explicitly refers to the trace elements prior to the hot rolling, not prior to the heating. Therefore, the limiting analytical values with respect to these elements do not have to be met by the manufacturers of the cathode sheets, that, however, does not automatically rule out their use for the proposed method. However, the formation of a particularly tight oxide layer prevents impurities from being removable by annealing. Therefore, these elements must be removed, optionally prior to the oxidation, if they exceed the limits stated in claims 1 and 2.

Carbon 0.5% C is soluble in nickel at a hot-rolling temperature of 1100° C. The solubility of carbon in nickel decreases sharply as the temperature drops. At room temperature, only 0.02% C is soluble in nickel. C contents that exceed this value are deposited as graphite upon cooling.

When nickel is heated in air, C preferentially oxidizes with respect to nickel. C segregates at the grain boundaries, where it reacts with penetrating oxygen in near-surface areas and forms voids. At high temperatures, for example the hot-rolling temperature of 1100° C., C also segregates with respect to the surface and is incorporated into the oxide layer. C reacts with inwardly diffusing oxygen at the metal-metal oxide interface, and then leaves voids behind. The bubble formation observed at the surface during annealing of nickel at temperatures of ≥760° C. is also attributed to C.

CO and $CO_2$ are formed by the reaction with oxygen. The gas pressure may make the material brittle due to loosening of the grain boundaries, and may cause an oxide layer that is already formed to tear or break off. The strip must then be ground or pickled.

In the analysis of cathode sheets for gases, on average 5.3, 7.8, and 28 ppm by weight $O_2$ have been detected, depending on the manufacturer. Since the diffusion of O is approximately 20 times that of C, diffusing O may react with C contained in the base metal and form CO and $CO_2$. For this reason, outgassing of CO and $CO_2$ may be detected, even during annealing of cathode sheets under vacuum. Therefore, inwardly diffusing oxygen from the ambient air is not even necessary for the gas evolution during heating. Accordingly, during the heating of nickel, pores also appear in the nickel grains, and not just at near-surface grain boundaries and at the metal-metal oxide boundary layer.

It was not possible to further reduce the low oxygen content mentioned above, even by annealing under vacuum and under a hydrogen-containing shielding gas, which indicates the presence of a second phase. For the nickel quality at the high mentioned oxygen content, 66% of the oxygen could be removed by annealing at 1200° C. for one hour under vacuum. Thus, the oxygen content was in the range of the other qualities.

Since the entry of oxygen into the material cannot be prevented during the hot rolling, it is not meaningful to attempt to reduce the content of oxygen contained in the material. It is more meaningful to reduce the C content prior to the hot rolling. The above-mentioned effects of C, such as void formation, brittleness of the metal, and tearing of the oxide layer do not occur until C contents <35 ppm by weight are reached, i.e. far below the solubility of C in nickel.

The C content may be reduced by annealing under vacuum. Tests have shown that the C content may be lowered from 20 ppm to 5 ppm by annealing at 700° C. for one hour under vacuum. Oxidizing C by annealing in moist hydrogen is particularly effective. The O that is released from the water bonds with the surface C, and in contrast to annealing in air, does not penetrate into the material due to the fact that O that does not bond with C bonds with H. As a result of the reaction of C with O, a concentration gradient is formed in the material that causes C to diffuse to the surface, where it bonds with O to form CO. This process depletes C from the entire metal body without resulting in grain boundary expansions due to gas formation in the metal body. In order to remove C by annealing in moist hydrogen, the contents of Mn, Al, and Si must be low enough that these elements do not form a glass-like film composed of manganese silicate ($Mn_3Si_8Al_3$).

Sulfur

Sulfur is soluble in nickel in concentrations up to 50 ppm. At concentrations exceeding this value, sulfur deposits as nickel sulfide at the grain boundaries. In the provided production path, the sulfur content must be 1/10 of this value at most. This is due to the fact that at annealing temperatures above approximately 750° C., sulfur diffuses to the surface and, at a rate that is higher by several orders of magnitude, segregates at the grain boundaries and from there migrates to the surface. The oxide layers that form are thus infiltrated. Because sulfides occupy a greater volume than the equivalent quantity of metal, stresses develop at the metal/oxide layer phase boundary that promote chipping of the oxide layer. In that case, the strip would have to be ground.

During the grain boundary and surface segregation, sulfur enrichment (surface concentration to core material concentration) of $10^4$ to $10^5$ occurs; therefore, the harmfulness of sulfur also depends on the sample thickness. For cathode sheets 12 to 15 mm thick that are heated to 1100° C. prior to the hot rolling, less than 5 ppm by weight sulfur is nonharmful, although only at sulfur contents below 0.6 ppm is there no surface segregation.

For the brief heating and rolling times and the temperatures thus reached, the diffusion and segregation of sulfur from the depths of the metal body is limited. For this reason, it was possible to dispense with determining the allowable sulfur content as a function of the sheet thickness.

For cathode sheet qualities whose S content is greater than 5 ppm at approximately the same sheet thickness, the sulfur content must be reduced by high-temperature annealing in dry hydrogen. In the process, the sulfur diffuses to the surface, where it evaporates or reacts with hydrogen.

Due to the formation of an oxide layer, impurities that tend to collect in the oxide layer or at the interface between the metal and the oxide layer are prevented from being removed by annealing. The high-temperature annealing must therefore be carried out before the surface oxidizes.

Silicon

Si oxidizes preferentially with respect to nickel, forming $SiO_2$. In electrolytically produced nickel, the Si content is not high enough for a closed $SiO_2$ intermediate layer to be able to form. However, $SiO_2$ may form islands beneath the NiO layer. Due to the different coefficients of expansion of $SiO_2$ and NiO, the cooling of the material after heating may cause the NiO layer to chip off in places.

Si oxides cannot be reduced by annealing in dry hydrogen; they would be rolled into the metal if the layer in which the oxide is enriched were not removed after the hot rolling. The Si content must therefore be strictly limited, in particular, to <15 ppm by weight.

Manganese

Manganese promotes the oxidation of nickel. Manganese oxidizes preferentially with respect to nickel, segregates at the grain boundaries and the surface, and forms oxides at the nickel/nickel oxide boundary layer. Because manganese also oxidizes preferentially with respect to C, manganese results in delayed oxidation of C.

The manganese content must therefore be limited to <14 ppm.

Magnesium

Magnesium oxidizes preferentially with respect to Ni. Particles containing Si, Mn, and Mg may be detected at the nickel/nickel oxide boundary layer. Magnesium promotes porosity due to the small molar volume of its oxide. It is not possible to reduce either C or H in the oxides of magnesium by annealing.

The magnesium content must therefore be limited to <11 ppm.

Aluminum

NiAl alloys form a protective, firmly adhering $Al_2O_3$ layer on the base body that makes the material resistant to high temperature, even with cyclical temperature control. However, the Al content in electrolytically obtained nickel is too low for it to be able to form a closed $Al_2O_3$ layer.

For low Al contents up to 1 mol-%, $Al_2O_3$ forms in the base matrix due to selective oxidation as the result of the high oxygen affinity of aluminum. Nickel ions diffuse further to the outside, where an NiO layer forms. Al therefore has a tendency toward layer formation. Aluminum oxide is very hard; it does not deform during rolling, and when foils are rolled it may result in hole formation. Al oxides cannot be reduced by annealing in dry hydrogen; they would be rolled into the metal if the layer in which the oxide is enriched were not removed after the hot rolling.

The Al content must therefore be strictly limited to <7 ppm by weight.

Titanium

Titanium migrates to the surface and is preferentially oxidized to $TiO_2$. Titanium cannot be reduced using customary heat treatment measures. The titanium content must therefore be limited to <25 ppm by weight.

Non-Limited Trace Elements

The fact that elements other than those stated in claims 1 and 2 are not mentioned does not mean that they would not be detrimental; rather, this means that for electrolytic production of material having a purity level that meets ASTM B 39-79 (reapproved 2004), these elements typically do not occur, do not occur in detrimental quantities, or may be removed to nonharmful levels using the proposed process path. This applies, for example, to trace elements that are detrimental per se, such as Bi, Pb, Te, Se, and P.

Cobalt

With regard to the proposed method, cobalt behaves like nickel. Therefore, it is not necessary to limit the cobalt content. Cobalt is much more expensive than nickel. For this reason, during nickel extraction it is separated and recovered separately. Therefore, the cobalt content in nickel cathode sheets is generally less than 60 ppm. However, 200 ppm has been detected in test material.

Chromium

Chromium has a higher affinity for oxygen than does nickel. Nevertheless, due to the higher reaction rate, an NiO layer initially forms during oxidation in air at a temperature of 1000° C. With continued heating, chromium contained in nickel diffuses toward the surface.

The chromium activity depends on the concentration in the alloy. For chromium contents of up to 7% by weight in nickel, the scaling constant increases much more intensely than for any of the other metallic trace elements; higher-valence metal ions, for example $Cr^{3+}$ cations, are incorporated into the NiO layer. The chromium activity is lower if only trace quantities of chromium are present in the nickel. Chromium is not detrimental in concentrations up to 100 ppm.

The chromium content in the cathode sheets tested was typically <5 ppm. No continuous chromium oxide layer forms at these chromium concentrations. Therefore, limiting the chromium content is not necessary.

Iron

With regard to the proposed method, the statements made for chromium similarly apply for iron. Fe also oxidizes before Ni. It is therefore surprising that even high Fe contents can be tolerated.

Iron oxides may be removed by annealing in dry hydrogen. Such annealing for reducing the nickel oxide is part of the process anyway. Iron oxides in concentrations up to 200 ppm have no detrimental effect on the proposed method. The iron concentrations in the tested cathode sheets were between >5 ppm and <200 ppm. Therefore, limitation is not necessary.

Copper

Nickel oxidizes before copper, and copper does not segregate, even at grain boundaries. Copper oxides may also be removed by annealing in dry hydrogen. No more than 75 ppm copper has been detected in the analyzed qualities; up to these values, copper is not detrimental. For sheets with limited analysis, the copper content is less than 1 ppm. Therefore, it was not necessary to limit the allowable content of copper in cathode sheets.

Hydrogen

Various cathode sheet qualities have been tested for their hydrogen content. At least one occurrence of hydrogen with a content of 0.6 ppm by weight has been identified. This corresponds to 5.3% by volume at standard conditions. However, contents of 1.1% and 3.2% by volume have also been detected.

Hydrogen has proven to be extremely detrimental during fusion welding. Hydrogen causes bath spattering that results in irregular weld seams, and initiates microporosity of the weld seam.

For this reason, H must be reduced to a residual content of <0.1 ppm by weight prior to the fusion welding. This may be carried out by heat treatment (from merely heating at 250° C. for one day, to annealing under vacuum or under shielding gas). According to calculations, at an annealing temperature of 1100° C. atomic hydrogen is outgassed from a 6-mm thick sheet after approximately 4 min. It has been shown that heating at 1100° C. in a continuous furnace for a run-through time of 800 seconds prior to the hot rolling is sufficient to reduce the hydrogen content to a level that allows welding without problems after the hot rolling. For a 90° bending sample, no crack formation was identifiable around a radius of 4 mm.

If sheets are not welded to the strip until after hot rolling, as a result of the prescribed method the hydrogen content does not have to be limited. If the sheets are joined by fusion welding prior to the hot rolling, it is advisable to expel the hydrogen prior to the heat treatment.

Nitrogen

The nitrogen content is relevant because nitrogen present in the material may result in pore formation during fusion welding. In cathode sheets, <2 ppm by weight nitrogen was detected in a gas analysis. This quantity of nitrogen is not detrimental to the welding.

Nitrogen contents greatly exceeding this value may be removed by annealing in dry hydrogen.

Advantages Achieved

In the production of a test coil, using material that was consistent with the analysis of claim 2, it has been shown that after the hot rolling, the material developed an oxide layer having an average thickness of only 2 μm, and that could be reduced to pure nickel by annealing in dry hydrogen in a high-convection hood-type annealing furnace.

To test whether the method is still usable when the sheets are joined prior to hot rolling and then introduced through a coilbox into a multistand hot-rolling mill train, and this crude strip in the coilbox is heated for an extended period without protection from oxidation due to a reducing atmosphere, 24-hour oxidation tests were carried out at 1100° C. with subsequent reduction over a period of 4 hours at 1160° C. on sheets that corresponded to claim 2. The C content had been reduced to <5 ppm by vacuum annealing.

Here as well, an oxide layer having only one layer was present, but the sheet had numerous pores in the interior, in particular in the area of the boundary of the starter sheet. Pores were also detected on the grain boundaries. Testing of the pores by SEM-EDX has shown that the pore inner walls beneath the near-surface area (0.1 mm) were not oxidized, so that the pore formation is likely caused by an accumulation of voids and lattice defects. This is supported by the presence of a prominent porous zone at the original starter sheet interface. It should be kept in mind that the hardness of the starter sheet and electrolytic growth differ from one another greatly, and the electrolytic deposits are under significant stress. Internal oxidation of pore inner walls near the surface also takes place at 1100° C. after a 24-hour annealing period (see FIG. 4). These internal oxides were also reduced during the subsequent reduction in shielding gas containing 5% $H_2$: in the samples from reduction annealing, round "nickel beads" surrounded by an annular gap were present. This phenomenon represents oxides that have been reduced by hydrogen, also inside the material. The annular gap results from the contraction in volume from NiO to Ni, and at the same time incorporates the reaction product ($H_2O$). However, the internal oxidation is much less pronounced than in nickel produced by reduction smelting.

The cover layer is foam-like and completely reduced, and adheres well to the base material (see FIG. 5).

Using the described method, the advantages of hot rolling, in particular the mass balancing in width, may be utilized without having to accept its disadvantages, such as the need for grinding or pickling after the hot rolling. Further advantages of the method are that the production can be carried out in existing industrial facilities without having to adapt their control systems. Sorting the sheets according to thickness is unnecessary, since all sheets have the same thickness after the hot rolling. The constant thickness, in particular when the sheets are aligned after the hot rolling, also simplifies welding the sheets into a strip, since alignment of the heights of the plates is not necessary, and it is also not necessary to produce a wedge-shaped transition between the welded plates in order to adapt to different thicknesses.

For this purpose, in selecting the usable material the analysis must be significantly limited in comparison to ASTM B 39-79 (reapproved 2004), the standard that must be met for the cathode qualities marketed by LME. Excess of the trace elements stated in claims 1 and 2 are acceptable only when these trace elements are reduced to the allowable values by a heat-treatment process.

The present invention further relates to the use of the strip, manufactured according to the above method steps, as a starter sheet for the production of cathode sheets.

The present invention further relates to the use of the strip or sheet, optionally divided, that is manufactured according to the above method steps as a starting material for the production of wire, in particular welding wire, having a nickel content of at least 99.94%, and starter sheets for the production of cathode sheets.

The present invention further relates to a starter sheet that is obtained according to any of the method steps described above.

The present invention further relates to a wire, in particular welding wire, that is obtainable from sheet or strip that is divided longitudinally, transversely, and/or in a pattern, and/or end pieces and/or side strips, not dimensionally accurate, that are separated before or after the hot rolling according to any of the method steps described above. For this purpose, the sheet sections intended for the production of wire are cut into strips having a rectangular cross section, which may also be curved (see FIG. 6) and welded on the end-face side, preferably by butt welding. The projecting weld edges are deburred, for example by shear trimming, and then processed into wire by rolling or drawing.

BRIEF DESCRIPTION OF THE DRAWING

The present invention is now described, with reference to illustrated embodiments.

The drawing shows the following.

SPECIFIC DESCRIPTION OF THE INVENTION

Application Example

Figure 1:
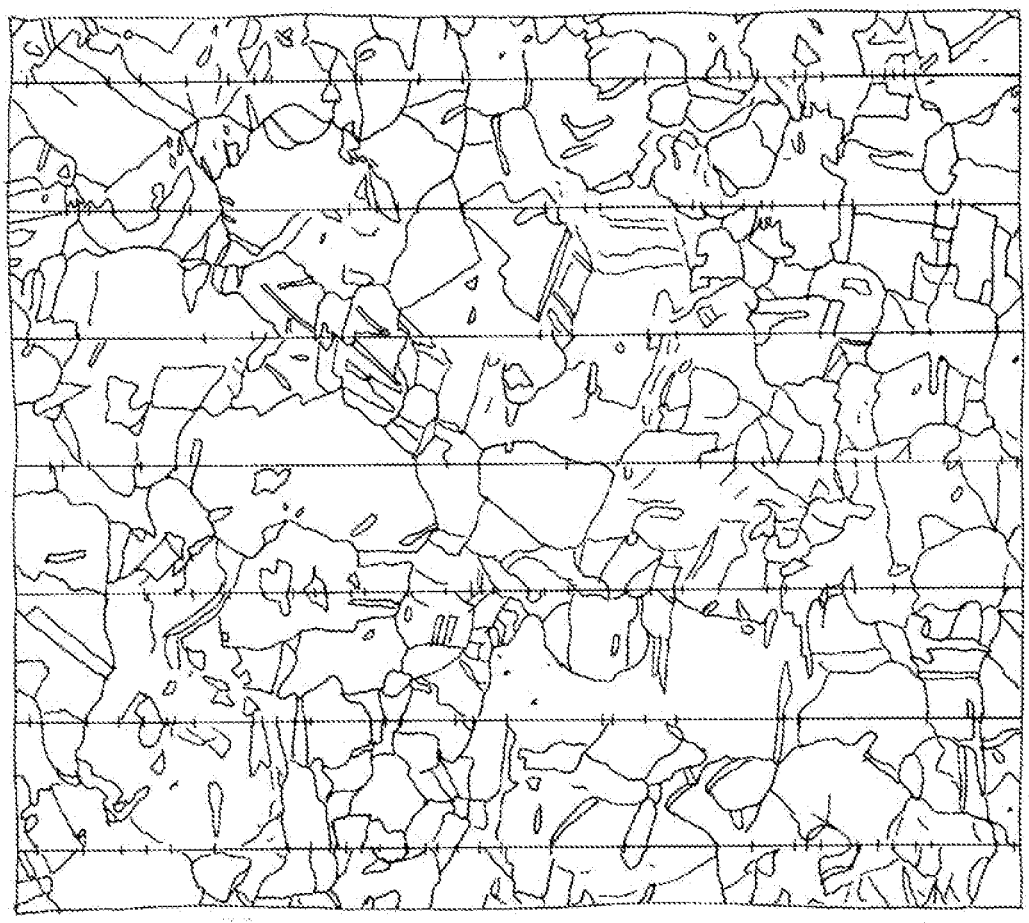
FIG. 1 shows the starting material, heated and hot-rolled according to the invention, as a metallographic cross section

Manufacture of Strip from Cathode Plates, with Limited Analysis

Starting Material

The selected starting material, having a thickness of 12 to 15 mm, gave the following analysis prior to the hot rolling:

| | Element | | | | | | | |
|---|---|---|---|---|---|---|---|---|
| | Ni | C | S | Mn | Mg | Al | Ti | Si |
| Unit | % by weight | ppm by weight | ppm by weight | ppm by weight | ppm by weight | ppm by weight | ppm by weight | ppm by weight |
| Value | >99.98 | <20 | <2.0 | 12 | 3 | <7 | <25 | <10 |

The material is typically delivered on pallets having a weight of approximately 1 t, using handles. The handles are cut off. The individual sheets were 1280 mm long, 720 mm wide, and 12 to 15 mm thick.

Electrolytically produced sheets have so-called buttons (nodules) on the surface. Since these buttons are fixedly joined to the base sheet and have a conical design, it is not necessary to grind the sheets in their entirety. Individual buttons that project markedly (starting at an approximately 6-mm height relative to the base of the button) were ground off.

Heating

As a result of the deposition process, the material is under high stress; for this reason, it may be recrystallized by vacuum annealing or annealing under shielding gas, also without prior deformation. At a temperature of 700° C., an annealing period of 1 hour is sufficient for this purpose. Annealing was carried out at 1100° C. for 800 seconds in a continuous furnace. Prior heat treatment for removing certain trace elements was not carried out. Annealing temperatures of approximately 900° to 1290° C. are customary.

Depending on the cathode quality, hydrogen concentrations of 0.6, 1.2, and 3.2 ppm by weight were determined in the delivered state. When vacuum annealing is performed at 350° C. for 1 hour, the concentration of 1.2 ppm dropped to 0.1 ppm, and at 750° C., dropped from 3.2 ppm to 0.1 ppm. When annealing is carried out under shielding gas containing hydrogen, the lowest value is achieved for a 1-hour annealing period at 400° C., and at higher temperatures the hydrogen is released from the shielding gas and into the metal. The annealing in the continuous furnace at 1100° C. for 800 seconds is sufficient to outgas hydrogen to the extent that bath spattering no longer occurs during welding.

Hot Rolling

The cathode sheets were hot-rolled in one heat to a uniform thickness of 6 mm; i.e. they were reduced by 50 to 60%. The minimum reduction of ≥20% may be ensured by the feed to the rollers or the pass schedule, and compliance with specifications may be checked using thickness gauges mounted in the roll stand. A reduction by at least 75% as required by U.S. Pat. No. 3,722,073 to avoid the formation of bubbles in the material was not necessary.

The hot rolling of strips is a very cost-effective process, and in any case is less expensive than thickness reduction by cold rolling. The overall thickness reduction of strips is therefore advantageously divided between hot rolling and cold rolling in such a way that the thinnest strips possible, for example <4 mm thick, are produced by hot rolling, and only the remaining reduction is performed by cold rolling. This corresponds to the examples stated in U.S. Pat. No. 3,722,073 (hot strip thickness: 3.175 mm; column 5, line 56 and column 6, line 24).

On the other hand, the hot rolling of sheets is a comparatively expensive process compared to the cold rolling of strips, so that the thickness reduction by hot rolling is limited to the maximum processable thickness on the available cold rolling unit. In the present case, this thickness was 6 mm.

The hot rolling began at a temperature of approximately 1070° C. Nickel is usually rolled at temperatures of 875° C. to 1250° C. This encompasses the temperature range stated in U.S. Pat. No. 3,722,073.

The different thicknesses of the starting material result in different sheet widths during rolling. The narrowest sheet determines the dimensions of the strip to be produced; widths exceeding this value result in scrap. By edging the sheets during the rolling, different sheet widths that result from the different sheet thicknesses may be prevented at the hot-rolling step.

Figure 2:
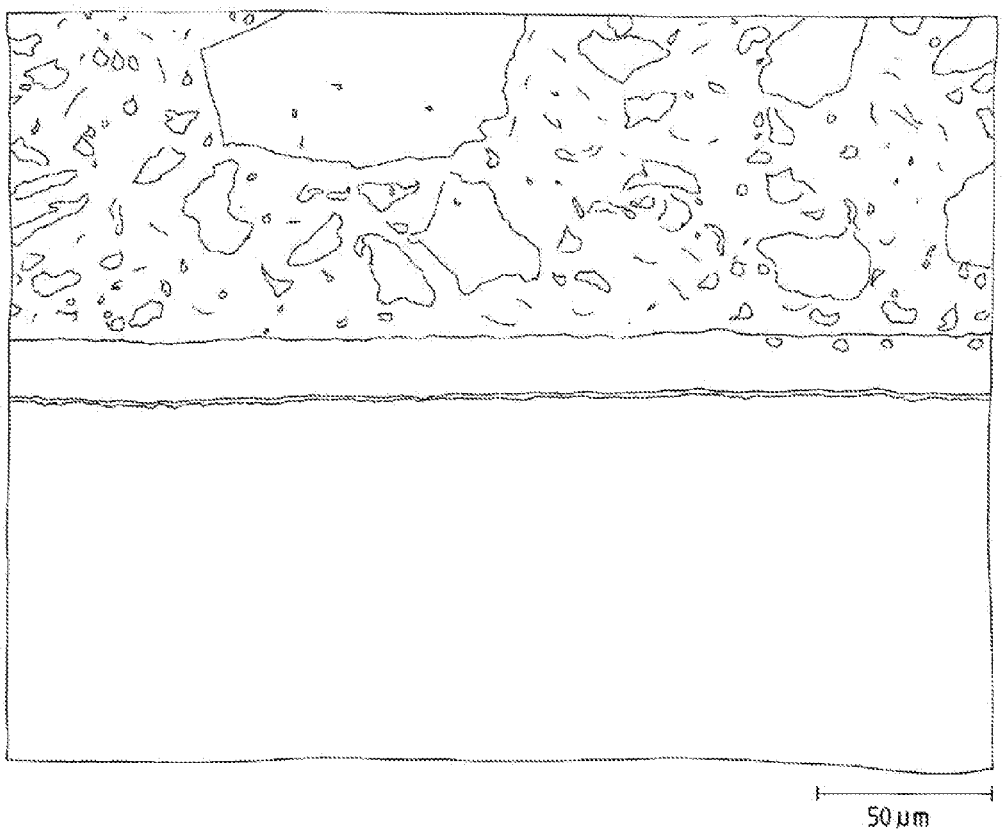
FIG. 2 shows a metallographic cross section, viewed transversely of the strip, illustrating the oxide layer
Figure 3:
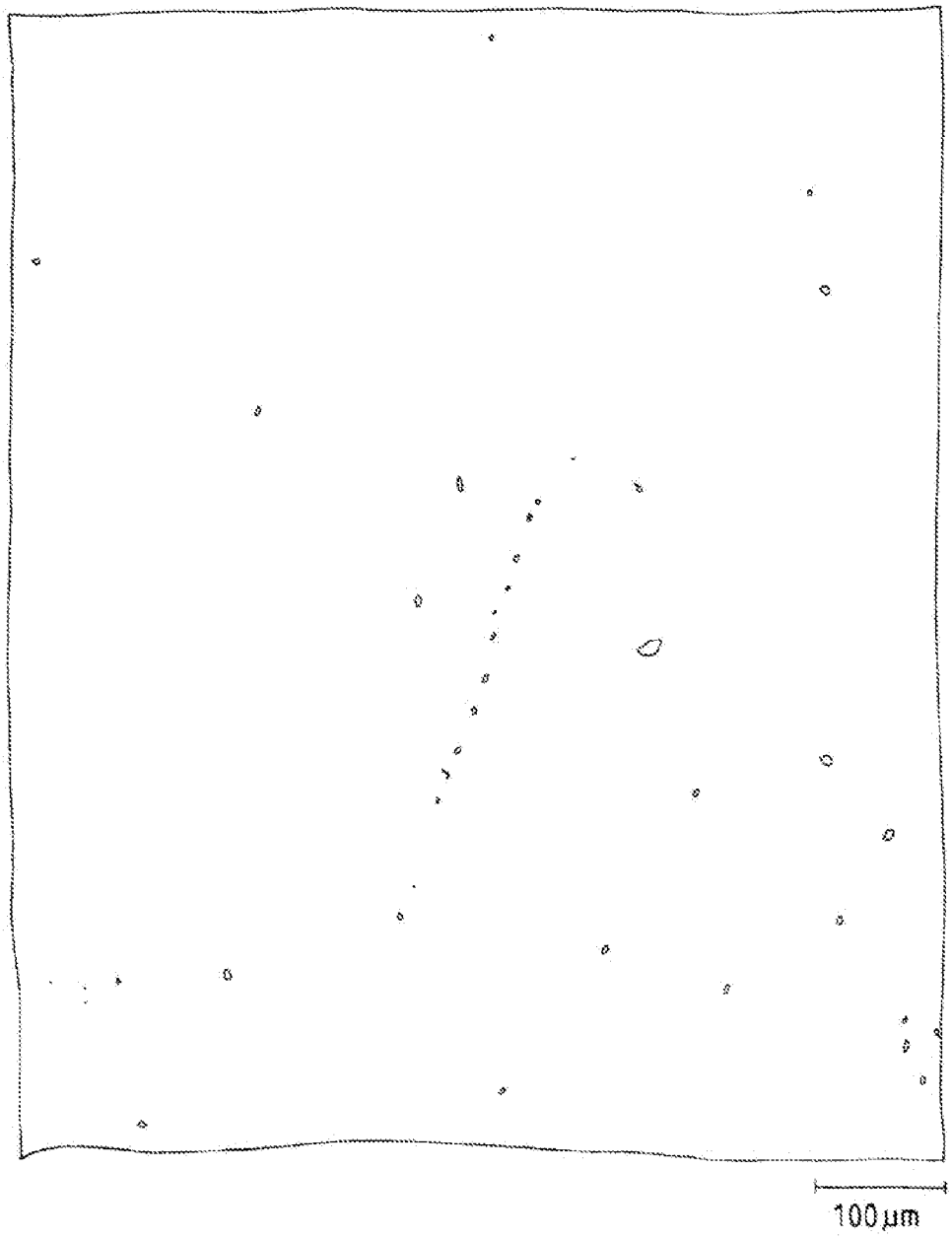
FIG. 3 shows a hot-rolled material that has been polished to illustrate internal corrosion
Figure 4:
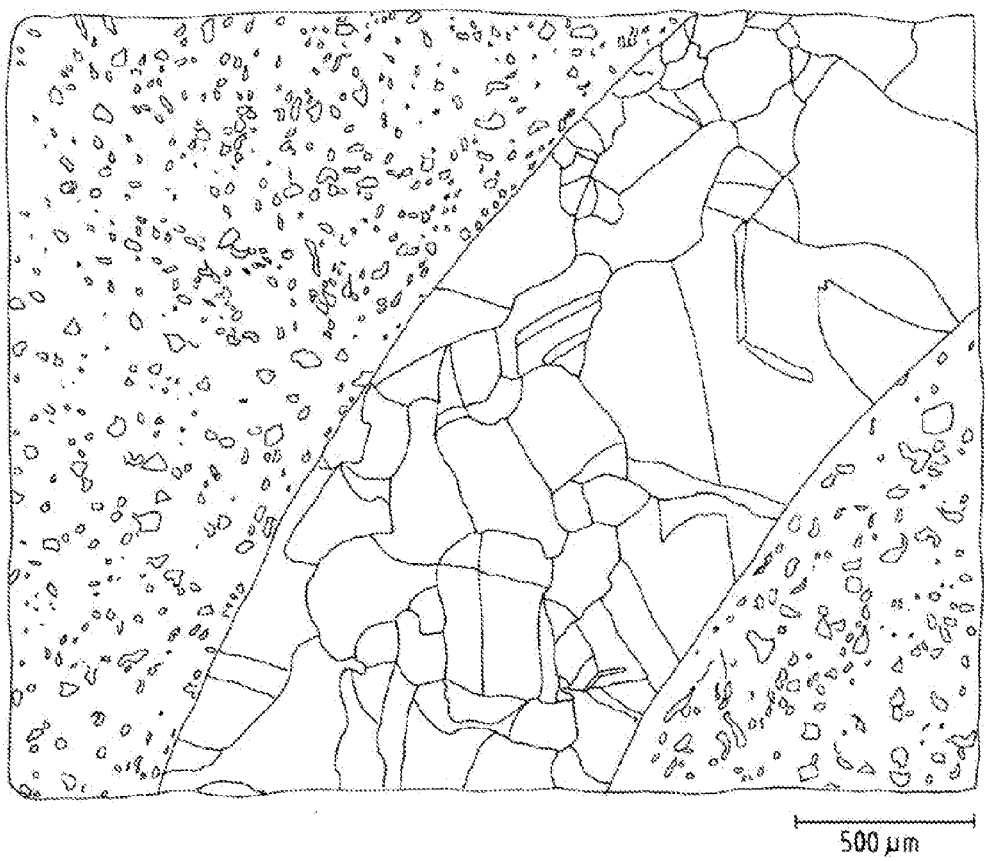
FIG. 4 shows a material subjected to 24-hour oxidation, magnified 50 times
Figure 5:
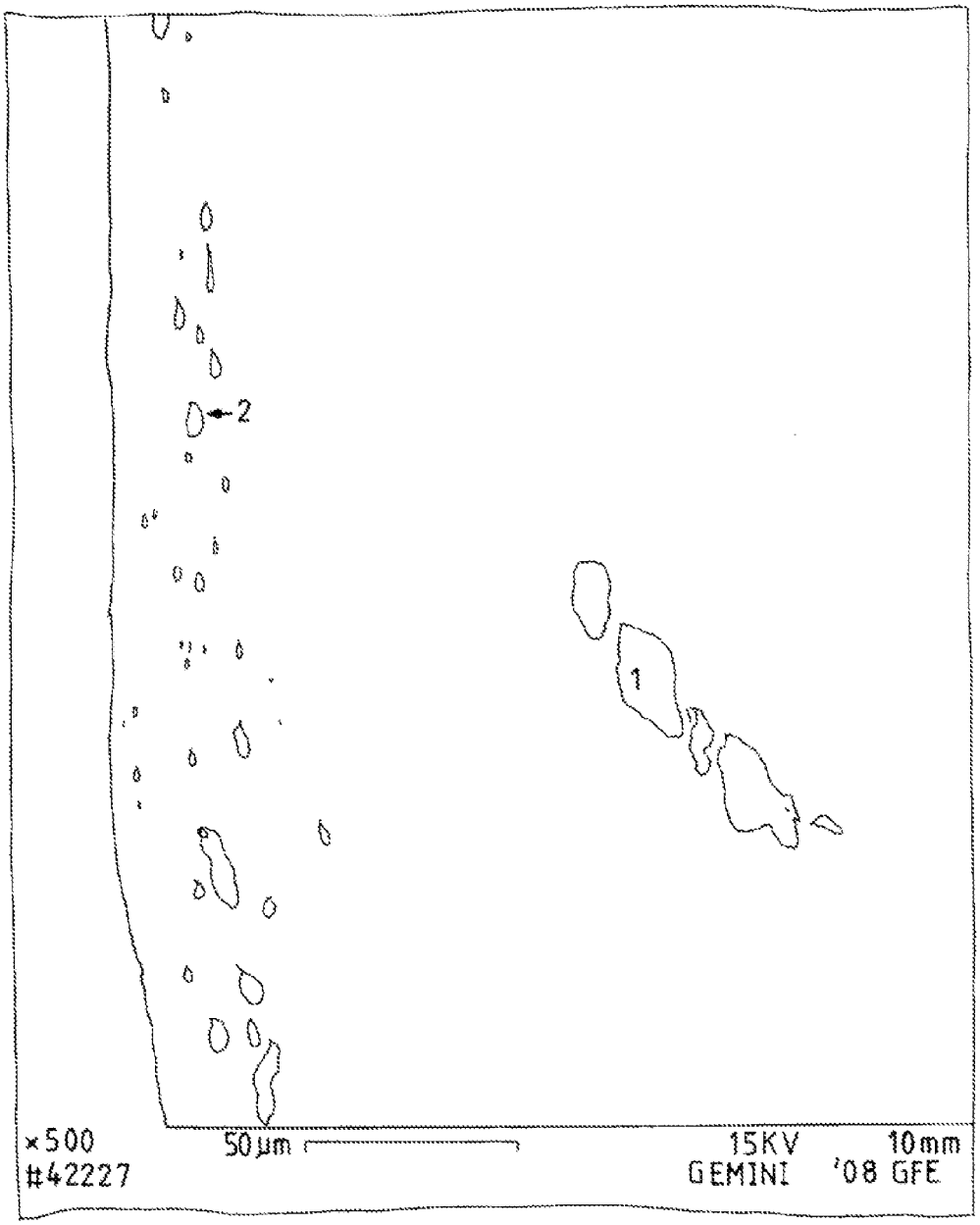
FIG. 5 shows the material according to FIG. 4 subjected to reduction, magnified 500 times

Heating and hot rolling, even at an overall reduction rate of only approximately 50%, result in such a tight bond of the starter sheet and the growth that splitting of the sheets no longer occurs during the subsequent cold rolling. The structure is completely recrystallized after the hot rolling (see FIG. 1). The average grain diameter was 62 μm. The grain size was determined using the intercepted segment method, based on a metallographic cross section with grain boundary etching. The grain size determined in accordance with ASTM E112 was 5.4. The average thickness of the oxide layer was approximately 2 μm, as determined based on a metallographic cross section viewed from the transverse direction of the strip (see FIG. 2). The oxide layer comprised only one layer. Internal corrosion or intergranular corrosion was not detectable. FIG. 3 shows a hot-rolled material that has been polished to illustrate internal corrosion. The second phase visible in the illustration, which is approximately 100 μm long and lined up in a row in a bead-like manner, was identifiable as a preparation contaminant based on depth of field tests.

The macrohardness determined according to Vickers was 98 HV10, and the average measured microhardness according to Vickers was 103 HV0.2.

The sheets were aligned after the hot rolling and cut to a uniform width with shears while still in the hot rolling mill; the rough-rolled ends were removed.

Figure 6:
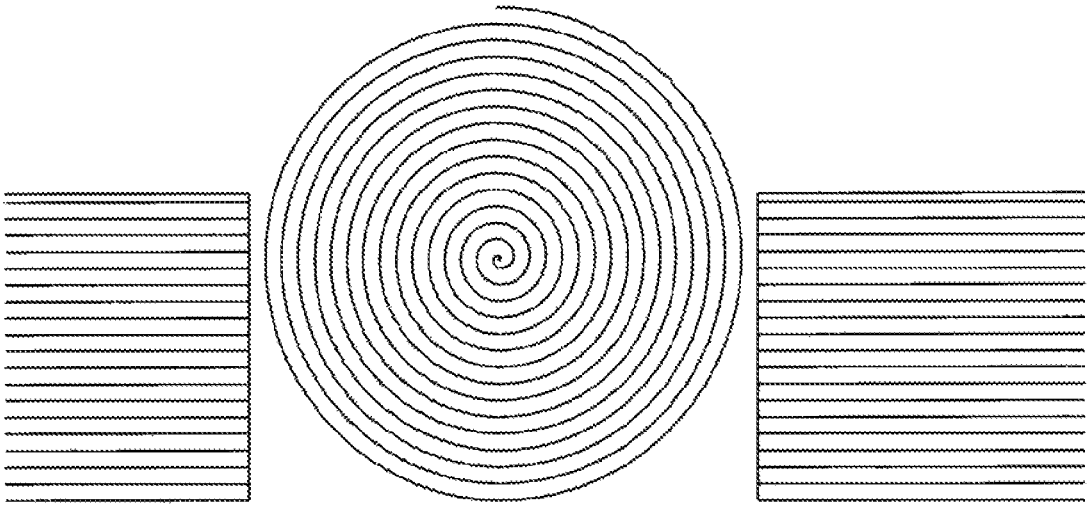
FIG. 6 shows an example of cutting open a separated rough-rolled end to form starting material for wire.

Removal of the handles and the side edges, not dimensionally accurate, after the hot rolling results in an overall scrap rate of approximately 20% relative to the yield. Since a surcharge must be paid with respect to the LME quotation for the pure starting material that is used, and on the other hand scrap is marketable only with a deduction with respect to the LME quotation, the avoidance and utilization of scrap are an integral component of the proposed method. The percentage of scrap may already be lowered by approximately 6.5% when the portion of the end pieces that is not dimensionally accurate is precisely determined, and only this portion is removed. This may be achieved by water jet cutting, for example. The rough-rolled ends and side strips that then remain may be divided longitudinally, transversely, and/or in a pattern (see FIG. 6) and used as starting material for the production of wire, among other things, for the ultrapure welding wire to be used according to claims 6 and 10. There are a number of uses for ultrapure nickel wire and flat wire, for example products that make use of the high positive temperature coefficient (PTC) of ultrapure nickel, for example as a temperature sensor or regulating coil as used in pencil-type glow plugs for regulating and limiting the temperature of the heating coils. Another use is for filler wires, manufactured from slit strip or flat wire, for welding.

Joining

The production of a weld seam that is rollable without incorporation of rolled-in matter is a precision operation:

- The sheets must be planar; otherwise, projections and infiltrations occur that result in rolling defects, in particular lapping.
- The sheets must abut at the ends with a technical zero gap, since otherwise the molten metal sags.
- The weld seam must not sink at the edge of the strip; otherwise, it is necessary to trim the entire strip.
- During welding, the weld seam must project slightly, since otherwise a sunken area results in rolling defects.

The edges must be removed using separating processes, in particular dividing, machining, ablation, and splitting, in such a way that no gap exceeding 2 mm, preferably 1 mm, occurs at any location after the plates are aligned.

Cutting the sheets at a right angle is advantageous for avoiding scrap; however, the sheets that are to be joined may also be cut at a corresponding angle or in a wave-shaped design, even if only for the sheets that abut one another with a technical zero gap before welding. In that case, the weld seam is longer than for a right-angled cut, and the load capacity of the weld seam is thus increased. However, the scrap rate also increases. Production of a long weld seam was not necessary in the example.

A chamfer of 30° was milled at the butt joints of the sheets to be joined, a line being milled at an exact angle of 90° relative to a longitudinal edge that was used for the subsequent alignment of the sheets. A chamfer may also be planed, or cut using a water jet cutting unit equipped with a three-dimensional head.

After the milling, the sheets were aligned with a technical zero gap and welded in two plies with pure nickel wire in the TIG process. To avoid having to trim the entire strip due to a sunken weld seam at the edge of the strip, the operation was performed with run-in and run-out pieces. During the welding, a slight elevation in the weld seam height was provided, since sunken weld seams may result in lapping during rolling. A pilot strip is welded on at the start and the end of the nickel strip. The strip resulting from the welding is coiled into plates.

The ultrapure nickel that is therefore relatively soft may also be joined by friction stir welding (FSW). Welding speeds of approximately 100 mm/min are achieved at a tool rotational speed of approximately 1200 rpm and a spindle force (z axis) of approximately 9 kN. It has turned out that preheating of the material and use of forming gas are not necessary. The use of expensive pure nickel welding wire, which is necessary for TIG welding, is dispensed with.

However, the use of tools made of tungsten-rhenium, other hard metals, and metal matrix composites (MMC) results in contamination of the weld seam due to abrasion. This jeopardizes the maintenance of a uniformly high purity level in the overall strip. To avoid contamination of the weld seam, pins loaded with polycrystalline cubic boron nitride (PCBN) should be used. Polycrystalline diamond (PCD) is unsuitable, since at operating temperatures above approximately 700° C.

the carbon, of which the diamond is composed, diffuses into the nickel. PCBN for use in tools is marketed, among others, by SII Advanced Materials, a business unit of Smith International, Inc., West Bountiful, Utah, USA, under the trade name MegaStir.

100% argon has been used as weld shielding gas, and 95% Ar+5% $H_2$ has been used as forming gas. Helium should not be used. The fact that helium, as an inert gas, does not react with the welding flux does not mean that no pores result when it is used as shielding gas. Nitrogen in the welding gas or in the forming gas produces pores. The standard gas mixture of 5% hydrogen ($H_2$) and 95% nitrogen ($N_2$) used as a forming gas is therefore detrimental for the present purpose.

Due to the protection of the welding area by shielding gas and forming gas, and the use of pure nickel wire as welding wire, the purity level of the material is not impaired during welding. The produced weld seams are sufficiently strong and pore-free that they may be lapped, and the strip may be cold-rolled at full reel tension.

After the hot rolling and welding, a material sample with a closed weld seam has the following values:

| Material state | Tensile strength | Yield point | Hardness | Elongation at break |
|---|---|---|---|---|
| [Unit] | MPa | MPa | HV1 | % |
| Annealed, hot-rolled | 320 | 100-112 | 80 | 66 to 75 |

Measuring method: DIN 50125 (2004)

In tensile tests the material fails in the base material, not in the weld seam.

The nickel strip could be coiled up without the oxide layer breaking or chipping. The coil produced from sheets by welding had a weight of 1.9 t, including pilot strips, in each case 4 m long, made of structural steel.

Bright Annealing

For a number of uses of the strip (for example, electronic components made of nickel foils), the strip that has been rolled to final dimensions must be free of inclusions. At least in these cases, it is necessary to remove oxides from strip produced by hot rolling, since otherwise the oxides are rolled into the material during the cold rolling whereupon they result in nonmetallic inclusions that due to their hardness do not take part in the deformation of the strip. The material may then tear during the manufacture of foils or during deep drawing.

The $H_2/H_2O$ ratio required for the reduction of NiO by hydrogen may be determined based on an Ellingham diagram. Accordingly, for the annealing of nickel at 1160° C., for example, a $H_2/H_2O$ ratio of at least $10^{-2}$ is necessary. A sponge-like surface structure results during reduction of the surface oxide layer by annealing in hydrogen.

Cold Rolling

The first pass is made at a reduced speed of approximately 30 to 50 m/min in order to even out the weld seams. Otherwise, the material may be rolled the same as for nickel produced by reduction smelting.

Separation of the sheets has not been observed during cold rolling after prior hot rolling.

Recrystallizing Annealing

The annealing temperature to be used depends on the grain size of the starting material, the strip thickness, and the cold rolling rate. Ultrapure nickel may be deformed by up to approximately 97% without intermediate annealing. After reduction by 88%. annealing temperatures of 200° C. for an annealing period of 2 hours are sufficient for the recrystallization.

The starting material used according to the invention, with limited values of trace elements, prevents bubble formation during the annealing, even using 100% hydrogen and at annealing temperatures of ≥760° C., i.e. under the conditions for which bubble formation occurs in the material according to U.S. Pat. No. 3,722,073. The described method thus increases the degrees of freedom in the selection of the annealing atmospheres and the annealing temperatures.

U.S. Pat. No. 3,722,073 attempts to achieve the sought objective by a high level of reduction during hot rolling (temperature-dependent: 75% to 92%, preferably 96% or greater) and at low temperatures (column 2, line 31), and particularly advantageously at estimated annealing temperatures of 510° to 650° C. (column 4, line 63). In the method described in the patent application, in any event when individual plates are hot-rolled, the majority of the reduction (calculated as the percentage of the particular starting material) is achieved by cold rolling. Due to the high overall reduction rate for cold rolling, the annealing temperature may be considerably below the lower limit stated in U.S. Pat. No. 3,722,073.

The invention claimed is:

1. A method of making a nickel strip composed of a plurality of at least substantially solid cathode sheets, the method comprising the steps of:

hot-rolling the sheets individually before or after being joined to one another to form the strip, and prior to the hot rolling, establishing that a starting material of the sheets has a minimum nickel content and a maximum trace element content as follows:

| | Element | | | | | | | |
|---|---|---|---|---|---|---|---|---|
| | NI | C | S | Mn | Mg | Al | Ti | Si |
| Unit | % by weight | ppm by weight | ppm by weight | ppm by weight | ppm by weight | ppm by weight | ppm by weight | ppm by weight |
| Value | ≥99.94 | <35 | <5 | <14 | <11 | <7 | <25 | <15. |

2. The method according to claim 1, wherein the minimum nickel content and the maximum trace element content is limited as follows:

| | Element | | | | | | | |
|---|---|---|---|---|---|---|---|---|
| | Ni | C | S | Mn | Mg | Al | Ti | Si |
| Unit | % by weight | ppm by weight | ppm by weight | ppm by weight | ppm by weight | ppm by weight | ppm by weight | ppm by weight |
| Preferably | ≥99.98 | ≤20 | ≤2 | ≤5 | <5 | ≤5 | <10 | ≤10. |

3. The method according to claim 1, wherein during the hot rolling differences in thickness within individual cathode sheets are reduced by a minimum reduction rate of ≥20% and the differences in thickness between cathode sheets are removed by the hot rolling to a uniform thickness such that, as the result of the minimum reduction rate of all sheets to be joined or already joined, even the thinnest of the sheets is reduced in thickness by at least 20%.

4. The method according to claim 3, wherein the hot-rolled, essentially solid sheets are joined by forging.

5. The method according to claim 1, further comprising the step after the hot rolling of:

subdividing hot-rolled sheets or hot-rolled strip or end pieces or side strips that are not dimensionally accurate longitudinally, transversely, or in a pattern and used as a starting material for an ultrapure welding wire.

6. The method according to claim 1, further comprising the step of:

aligning edges of the sheets to be joined after the hot rolling;

cutting the sheets to size after being aligned such that the aligned and cut-to-size strips abut one another with a technical zero gap to impart to the strip a linear axis; and joining the edges are subsequently by welding.

7. The method according to claim 6, wherein the sheets are joined by TIG fusion welding using a pure nickel welding wire having the nickel content defined for the sheets in claim 1, gases used in the TIG fusion welding are free of nitrogen and helium, a weld-shielding gas being used that is 100% argon, and a welding gas being used that is composed of argon and contains at least 5% hydrogen.

8. The method according to claim 7, wherein prior to joining by fusion welding, the hydrogen content of the sheets, which is determinable by melt extraction, is reduced by heat treatment to ≤0.5 ppm by weight.

9. The method according to claim 6, wherein the hot-rolled, essentially solid sheets are joined by resistance butt welding or by friction stir welding using an abrasion-resistance tool manufactured using PCBN.

10. The method according to claim 1, wherein the essentially solid sheets are aligned and cut to size at the edges to be welded in such a way that they abut one another with a technical zero gap and are joined before hot-rolling by fusion welding, (flash-) butt welding, or friction stir welding, or forging.

11. The method according to claim 10, wherein for the joining by fusion welding, a pure nickel wire that meets the analytical values defined in claim 1 for the sheets is used as a welding wire, and gases used are free of nitrogen and helium, weld-shielding gas being composed of 100% argon, and a welding gas also composed of argon and containing at least 5% hydrogen.

12. The method according to claim 1, wherein an oxide layer that results from the hot rolling is converted by reduction annealing in hydrogen to pure nickel that firmly adheres to a base body.

13. The method according to claim 12, further comprising the step of:

removing a sponge-like structure and surface roughness of an oxide layer that developed as a result of the annealing by cold rolling using reel tension, and further reducing a thickness of the strip to final dimensions by cold rolling under reel tension such that emulsion or oil taken in by the sponge-like structure during rolling is removed by the subsequent annealing under hydrogen.

14. A method of making a nickel strip, the method comprising the steps of:

providing a plurality of solid cathode sheets that have a minimum nickel content of 99.94% by weight and a maximum trace element content, in ppm by weight, of <35 carbon, <5 sulphur, <14 manganese, <11 magnesium, <11 aluminum, <25 titanium, and <15 silicon;

hot-rolling the sheets individually in a single layer/ply; and joining the sheets to form the strip.

* * * * *